US008561857B2

(12) United States Patent
DeMarco et al.

(10) Patent No.: US 8,561,857 B2
(45) **Date of Patent: *Oct. 22, 2013**

(54) CONTAINER CAPS AND SYSTEMS

(75) Inventors: Jenny DeMarco, Frisco, TX (US); John Lamie, Old Greenwich, CT (US)

(73) Assignee: Mark Kay Inc., Dallas, TX (US)

( * ) Notice: Subject to any disclaimer, the term of this patent is extended or adjusted under 35 U.S.C. 154(b) by 34 days.

This patent is subject to a terminal disclaimer.

(21) Appl. No.: 13/558,134

(22) Filed: Jul. 25, 2012

(65) Prior Publication Data

US 2012/0285960 A1 Nov. 15, 2012

Related U.S. Application Data

(63) Continuation of application No. 12/407,391, filed on Mar. 19, 2009, now Pat. No. 8,251,263.

(60) Provisional application No. 61/039,061, filed on Mar. 24, 2008.

(51) Int. Cl.
*B67D 3/00* (2006.01)

(52) U.S. Cl.
USPC ..... 222/483; 222/484; 222/488; 222/557; 222/561; 220/253; 220/256.1; 220/254.9

(58) Field of Classification Search
USPC ..... 220/253, 254.1, 254.7, 254.8, 256.1, 220/254.9, 259.3; 215/316; 222/482, 483, 222/484, 488, 557, 561
See application file for complete search history.

(56) References Cited

U.S. PATENT DOCUMENTS

| | | | | |
|---|---|---|---|---|
| 1,124,523 | A | 1/1915 | Reeser | 222/480 |
| 1,891,031 | A | 12/1932 | Arsdale | 222/545 |
| 2,381,707 | A | 8/1945 | Coleman | 215/206 |
| 2,961,228 | A | 11/1960 | Moore | 432/262 |
| 3,029,003 | A | 4/1962 | Gronemeyer | 222/545 |
| 3,042,273 | A | 7/1962 | Bauer el al. | 222/548 |
| 3,094,283 | A | 6/1963 | Balister | 239/393 |
| 3,149,755 | A | 9/1964 | Porter et al. | 222/83 |
| 3,204,836 | A | 9/1965 | Joffe | 222/545 |
| 3,214,069 | A | 10/1965 | Dike | 222/498 |
| 3,388,841 | A | 6/1968 | McHardy | 222/548 |
| 3,419,198 | A | 12/1968 | Petterson | 222/541.2 |
| 3,429,481 | A | 2/1969 | Navia | 222/83 |

(Continued)

FOREIGN PATENT DOCUMENTS

| | | |
|---|---|---|
| CH | 598 066 A5 | 2/1952 |
| CH | 280 997 A | 4/1978 |

(Continued)

OTHER PUBLICATIONS

International Search Report and Written Opinion, issued in International Application No. PCT/US2009/031805, mailed Mar. 10, 2009.

(Continued)

*Primary Examiner* — Mickey Yu
*Assistant Examiner* — Kareen Rush
(74) *Attorney, Agent, or Firm* — Fulbright & Jaworski LLP

(57) ABSTRACT

Caps and container systems suited to dispensing products like cosmetics. Some of the caps include two portions that can be coupled together and that include a dispensing system that has at least two open positions and at least one closed position.

6 Claims, 5 Drawing Sheets

(56) References Cited

U.S. PATENT DOCUMENTS

| | | | | |
|---|---|---|---|---|
| 3,467,287 | A | 9/1969 | Marchant et al. | 222/480 |
| 3,860,111 | A | 1/1975 | Thompson | 206/534 |
| 3,889,852 | A | 6/1975 | Strefford | 43/112 |
| 3,991,908 | A | 11/1976 | Thomas et al. | 221/154 |
| D247,848 | S | 5/1978 | Croyle | D9/447 |
| 4,179,051 | A | 12/1979 | Thomas | 222/494 |
| 4,220,248 | A | 9/1980 | Wilson et al. | 215/235 |
| 4,261,486 | A | 4/1981 | Bush et al. | 222/517 |
| 4,299,339 | A | 11/1981 | Giroux et al. | 222/153.14 |
| D263,805 | S | 4/1982 | Seager | D9/450 |
| 4,346,823 | A | 8/1982 | Eppenbach | 222/443 |
| 4,358,032 | A | 11/1982 | Libit | 222/498 |
| 4,377,247 | A | 3/1983 | Hazard et al. | 222/517 |
| 4,380,307 | A | 4/1983 | Stillinger | 222/142.9 |
| 4,432,760 | A | 2/1984 | Mittleman et al. | 604/246 |
| 4,457,458 | A | 7/1984 | Heinol | 222/498 |
| D275,655 | S | 9/1984 | Bainton | D9/438 |
| 4,500,016 | A | 2/1985 | Funfstuck | 222/153.14 |
| 4,519,517 | A | 5/1985 | Walter | 215/253 |
| 4,538,653 | A | 9/1985 | Shea et al. | 141/285 |
| 4,570,817 | A | 2/1986 | Hambleton et al. | 220/345.2 |
| 4,598,837 | A | 7/1986 | Kreiseder et al. | 220/253 |
| 4,613,063 | A | 9/1986 | Wright | 222/153.14 |
| 4,625,898 | A | 12/1986 | Hazard | 222/517 |
| 4,653,672 | A | 3/1987 | Tuerk et al. | 222/153.14 |
| 4,666,068 | A | 5/1987 | Bush | 222/546 |
| D291,536 | S | 8/1987 | Crawford et al. | D9/440 |
| 4,699,299 | A | 10/1987 | Gach | 222/480 |
| 4,793,502 | A | 12/1988 | Beck | 215/235 |
| 4,807,768 | A | 2/1989 | Gach | 215/216 |
| 4,826,026 | A | 5/1989 | Gach et al. | 215/206 |
| 4,852,770 | A | 8/1989 | Sledge et al. | 222/153.14 |
| 4,856,995 | A | 8/1989 | Wagner | 433/215 |
| D306,701 | S | 3/1990 | Beck | D9/446 |
| 4,993,606 | A | 2/1991 | Bolen et al. | 227/546 |
| D315,308 | S | 3/1991 | Van Kerkhoven | D9/450 |
| D315,872 | S | 4/1991 | Bixler | D9/446 |
| 5,005,737 | A | 4/1991 | Rohr | 222/212 |
| 5,007,555 | A | 4/1991 | Beck | 220/254.3 |
| 5,040,694 | A | 8/1991 | Gambello | 220/255 |
| D320,746 | S | 10/1991 | Bolen et al. | D9/446 |
| 5,058,778 | A | 10/1991 | Weinstein | 222/209 |
| 5,062,542 | A | 11/1991 | Morton | 220/269 |
| 5,065,911 | A | 11/1991 | Rohr et al. | 222/517 |
| 5,105,959 | A | 4/1992 | Kinsley | 215/227 |
| 5,123,574 | A | 6/1992 | Poulos | 222/362 |
| D328,710 | S | 8/1992 | Deflander | D9/529 |
| D328,711 | S | 8/1992 | Deflander | D9/524 |
| 5,161,718 | A | 11/1992 | Gueret | 222/212 |
| D334,538 | S | 4/1993 | Bolen et al. | D9/447 |
| D334,709 | S | 4/1993 | Fleming et al. | D9/449 |
| 5,199,617 | A | 4/1993 | Bennet | 222/498 |
| 5,211,300 | A | 5/1993 | Hsing et al. | 215/11.4 |
| 5,213,235 | A | 5/1993 | Miranda | 222/107 |
| 5,213,238 | A | 5/1993 | Martin et al. | 222/480 |
| D336,430 | S | 6/1993 | Maguire et al. | D9/448 |
| 5,242,075 | A | 9/1993 | Ott et al. | 220/361 |
| D340,188 | S | 10/1993 | Forsyth | D9/449 |
| D341,225 | S | 11/1993 | Lang et al. | D28/76 |
| 5,289,945 | A | 3/1994 | Stradder | 222/23 |
| 5,325,999 | A | 7/1994 | Gueret | 222/212 |
| D349,647 | S | 8/1994 | Moffit | D9/435 |
| 5,356,017 | A | 10/1994 | Rohr et al. | 215/216 |
| 5,358,130 | A | 10/1994 | Mengua et al. | 215/238 |
| 5,358,132 | A | 10/1994 | Bennett | 220/253 |
| 5,358,146 | A | 10/1994 | Stull | 222/148 |
| D352,457 | S | 11/1994 | Hughes et al. | D9/447 |
| 5,361,920 | A | 11/1994 | Nozawa et al. | 215/237 |
| 5,366,115 | A | 11/1994 | Kersten et al. | 222/105 |
| 5,379,926 | A | 1/1995 | Mueller et al. | 222/507 |
| D357,200 | S | 4/1995 | Thomas | D10/103 |
| 5,419,446 | A | 5/1995 | Cox et al. | 215/21 |
| D359,905 | S | 7/1995 | Molo | D9/447 |
| 5,437,383 | A | 8/1995 | Stull | 215/235 |
| 5,489,035 | A | 2/1996 | Fuchs | 215/235 |
| 5,507,419 | A | 4/1996 | Martin et al. | 222/480 |
| 5,520,307 | A | 5/1996 | Miller et al. | 221/2 |
| 5,533,649 | A | 7/1996 | Von Schuckmann | 222/153.14 |
| D374,399 | S | 10/1996 | Neveras et al. | D9/447 |
| 5,566,850 | A | 10/1996 | Forsyth et al. | 220/253 |
| 5,601,213 | A | 2/1997 | Daniello | 222/456 |
| 5,620,114 | A | 4/1997 | Chalfa, Jr. | 222/23 |
| D385,791 | S | 11/1997 | Forsyth et al. | D9/447 |
| D389,761 | S | 1/1998 | Thomas | D10/103 |
| 5,730,322 | A | 3/1998 | Iba et al. | 222/42 |
| 5,738,236 | A | 4/1998 | Brun, Jr. | 220/253 |
| 5,785,213 | A | 7/1998 | Guillot | 222/553 |
| D407,976 | S | 4/1999 | Ekkert | D9/449 |
| 5,913,435 | A | 6/1999 | Fuchs | 215/237 |
| 5,927,556 | A | 7/1999 | Mooney et al. | 222/153.14 |
| 5,960,972 | A | 10/1999 | Larguia | 215/274 |
| 5,975,354 | A | 11/1999 | Goncalves | 222/39 |
| D418,363 | S | 1/2000 | Barnes et al. | D7/392 |
| 6,089,411 | A | 7/2000 | Baudin et al. | 222/212 |
| D443,518 | S | 6/2001 | Goettner | D9/530 |
| 6,241,128 | B1 | 6/2001 | McClean et al. | 222/212 |
| 6,244,470 | B1 | 6/2001 | Harley-Wilmot | 222/153.14 |
| D444,387 | S | 7/2001 | Adachi et al. | D9/529 |
| 6,283,339 | B1 | 9/2001 | Morrow | 222/452 |
| 6,302,301 | B1 | 10/2001 | Vette | 222/142.6 |
| 6,315,170 | B1 | 11/2001 | Thomson et al. | 222/361 |
| 6,332,551 | B1 | 12/2001 | Copeland | 220/262 |
| 6,336,460 | B2 | 1/2002 | Yuhara | 132/295 |
| 6,378,735 | B1 | 4/2002 | Chu | 222/158 |
| 6,382,476 | B1 | 5/2002 | Randall et al. | 222/545 |
| 6,394,323 | B2 | 5/2002 | McClean et al. | 222/534 |
| 6,405,867 | B1 | 6/2002 | Moore | 206/459.1 |
| 6,405,885 | B1 | 6/2002 | Elliot | 215/237 |
| 6,419,825 | B1 | 7/2002 | Hahmann et al. | 210/232 |
| 6,439,442 | B1 | 8/2002 | Markert et al. | 222/547 |
| D468,639 | S | 1/2003 | Wennerstrom et al. | D9/449 |
| D470,765 | S | 2/2003 | Baker | D9/420 |
| 6,543,650 | B1 | 4/2003 | Sprick et al. | 222/153.14 |
| 6,564,978 | B1 | 5/2003 | Safian et al. | 222/534 |
| D475,618 | S | 6/2003 | Barnes et al. | D9/414 |
| D476,559 | S | 7/2003 | Norris et al. | D9/442 |
| D477,532 | S | 7/2003 | Wong | D9/449 |
| D479,803 | S | 9/2003 | Alguire et al. | D9/523 |
| 6,615,473 | B2 | 9/2003 | McClean et al. | 29/434 |
| 6,622,895 | B2 | 9/2003 | McClean et al. | 222/570 |
| RE38,328 | E | 11/2003 | Gueret | 222/144.5 |
| D485,181 | S | 1/2004 | Yourist | D9/454 |
| 6,691,394 | B1 | 2/2004 | McClean | 29/434 |
| 6,698,590 | B2 | 3/2004 | Moore | 206/459.1 |
| 6,702,161 | B2 | 3/2004 | Adams et al. | 222/521 |
| D488,383 | S | 4/2004 | Kudo et al. | D9/522 |
| 6,757,957 | B2 | 7/2004 | McClean et al. | 29/453 |
| 6,766,926 | B1 | 7/2004 | Elchert | 222/498 |
| D494,468 | S | 8/2004 | Vovan | 9/435 |
| 6,783,031 | B2 | 8/2004 | Robbins et al. | 222/111 |
| D497,802 | S | 11/2004 | Haggerty et al. | D9/417 |
| 6,854,619 | B2 | 2/2005 | Knickerbocker | 222/1 |
| 6,866,208 | B2 | 3/2005 | Kao | 239/526 |
| 6,905,082 | B1 | 6/2005 | Wu | 239/436 |
| D508,402 | S | 8/2005 | Hierzer et al. | 9/449 |
| D508,411 | S | 8/2005 | Lamb et al. | D9/689 |
| D509,137 | S | 9/2005 | Hierzer et al. | D9/447 |
| D509,138 | S | 9/2005 | Hierzer et al. | D9/447 |
| D509,428 | S | 9/2005 | Hierzer et al. | D9/447 |
| D509,429 | S | 9/2005 | Hierzer et al. | D9/447 |
| D509,430 | S | 9/2005 | Hierzer et al. | D9/447 |
| D509,431 | S | 9/2005 | Hierzer et al. | D9/447 |
| D509,432 | S | 9/2005 | Hierzer et al. | D9/447 |
| D509,735 | S | 9/2005 | Hierzer et al. | D9/447 |
| D509,736 | S | 9/2005 | Hierzer et al. | D9/447 |
| D509,737 | S | 9/2005 | Hierzer et al. | D9/447 |
| 6,948,641 | B1 | 9/2005 | Williams | 222/456 |
| D512,635 | S | 12/2005 | Hierzer et al. | D9/447 |
| 6,971,547 | B2 | 12/2005 | Englert et al. | 222/1 |
| 6,988,642 | B2 | 1/2006 | Gallo et al. | 222/506 |
| D515,917 | S | 2/2006 | Hierzer et al. | D9/447 |
| D515,918 | S | 2/2006 | Hierzer et al. | 9/447 |
| D515,919 | S | 2/2006 | Hierzer et al. | D9/447 |
| D516,910 | S | 3/2006 | Bresler | D9/447 |

(56) References Cited

U.S. PATENT DOCUMENTS

| | | | | |
|---|---|---|---|---|
| D518,712 | S | 4/2006 | Hierzer et al. | D9/447 |
| D518,713 | S | 4/2006 | Hierzer et al. | D9/447 |
| D518,714 | S | 4/2006 | Hierzer et al. | D9/447 |
| D518,715 | S | 4/2006 | Hierzer et al. | D9/447 |
| D529,800 | S | 10/2006 | Liebe | D9/449 |
| D530,202 | S | 10/2006 | Herald et al. | D9/449 |
| 7,128,227 | B2 | 10/2006 | Skillin et al. | 215/235 |
| D533,063 | S | 12/2006 | Lee et al. | D9/449 |
| D533,074 | S | 12/2006 | Mongeon et al. | D9/687 |
| D535,564 | S | 1/2007 | Toth et al. | D9/522 |
| D538,161 | S | 3/2007 | Smith et al. | D9/449 |
| 7,201,288 | B2 | 4/2007 | Von Ronn et al. | 220/253 |
| 7,225,938 | B2 | 6/2007 | Frisch | 215/11.4 |
| D548,086 | S | 8/2007 | Conway et al. | D9/732 |
| 7,331,478 | B2 | 2/2008 | Aljadi | 215/11.4 |
| 7,374,053 | B2 | 5/2008 | Herald et al. | 215/237 |
| 7,475,833 | B2 | 1/2009 | Chih | 239/394 |
| D587,581 | S | 3/2009 | DeMarco et al. | D9/454 |
| 7,513,399 | B2 | 4/2009 | Mengeu | 222/575 |
| 7,575,123 | B2 * | 8/2009 | Laveault et al. | 220/214 |
| D604,160 | S * | 11/2009 | DeMarco | D9/449 |
| 7,648,037 | B2 | 1/2010 | Ohashi | 215/313 |
| 7,651,003 | B2 | 1/2010 | Albers et al. | 215/311 |
| 7,748,579 | B1 | 7/2010 | Shin | 222/450 |
| 7,766,197 | B2 | 8/2010 | Getsy | 222/480 |
| 7,871,020 | B2 * | 1/2011 | Nelson et al. | 239/445 |
| 7,878,350 | B2 * | 2/2011 | Ramoundos | 215/230 |
| 2001/0011446 | A1 | 8/2001 | McClean et al. | 53/452 |
| 2003/0042331 | A1 | 3/2003 | Lu | 239/436 |
| 2005/0082290 | A1 | 4/2005 | Fask et al. | 220/254.1 |
| 2005/0205607 | A1 | 9/2005 | Hierzer et al. | 222/153.1 |
| 2006/0037886 | A1 | 2/2006 | Thiebaut | 206/581 |
| 2006/0237388 | A1 | 10/2006 | Kick | 215/235 |
| 2006/0249473 | A1 | 11/2006 | Kunz | 215/235 |
| 2007/0187406 | A1 | 8/2007 | Nobile et al. | 220/254.4 |

FOREIGN PATENT DOCUMENTS

| | | |
|---|---|---|
| CN | 12660077 | 9/2000 |
| EP | 1 022 229 | 7/2000 |
| JP | D1113385 | 3/2001 |
| JP | D1155998 | 10/2002 |
| TW | 281588 | 3/1984 |
| TW | D101297 | 10/1992 |

OTHER PUBLICATIONS

Office Communication issued in Chinese patent application No. 200980000033.3, dated Nov. 16, 2011. (English translation).

Office Communication, issued in U.S. Appl. No. 12/358,408, mailed on Sep. 15, 2011.

Office Communication, issued in U.S. Appl. No. 12/358,408, mailed on Feb. 9, 2012.

PCT International Preliminary Report on Patentability, issued in International Application No. PCT/US2009/03185, dated Oct. 22, 2010.

Search Report issued in Taiwan Application No. 097304400, dated Mar. 30, 2009.

* cited by examiner

CONTAINER CAPS AND SYSTEMS

CROSS-REFERENCE TO RELATED APPLICATIONS

This application is a continuation of U.S. application Ser. No. 12/407,391, filed Mar. 19, 2009, which claims the benefit of U.S. Provisional Application No. 61/039,061, filed Mar. 24, 2008. The contents of these applications are incorporated by reference.

BACKGROUND OF THE INVENTION

1. Field of the Invention

The present invention relates generally to containers, and, more particularly, to container caps and systems.

2. Description of Related Art

Products are typically stored within containers. For example, cosmetic and food products are often stored in bottles and the like. A container may have a cap or lid that allows a consumer to have access to the product in a controlled fashion. When the cap is in an open position, the product is dispensed typically under an externally applied pressure and/or due to the force of gravity. When the cap is in a closed position, the product is stopped from leaving the container.

SUMMARY OF THE INVENTION

The present invention provides container caps and systems. Some embodiments of the present caps include a bottom portion having a top surface that includes a centered opening, a first recessed holding element coupled to the centered opening through a first recessed region, a second recessed holding element coupled to the centered opening through a second recessed region, and a raised element coupled to the centered opening; and a top portion couplable to the bottom portion, the top portion having a bottom surface that includes an off-centered opening, a first raised element, and a second raised element.

In some embodiments, the present caps include a top portion and a bottom portion, the top portion being couplable to the bottom portion, the top and bottom portions being configured to cause the cap to reach an open position starting from a closed position when: the top portion is rotated in a clockwise direction with respect to the bottom portion from a closed position; and the top portion is rotated in a counterclockwise direction with respect to the bottom portion from the closed position; the top and bottom portions being configured to restrict relative rotation between them to less than 360 degrees. In some embodiments, such rotation is restricted to approximately 240 degrees. In other embodiments, such rotation is restricted to approximately 90 degrees. In still other embodiments, such rotation is restricted to approximately 60 degrees.

Some embodiments of the present container systems include a bottle configured to hold a product, and a two-piece cap coupled to the bottle. The two-piece (or two-portion) cap may include a dispensing system that includes two or more open positions and one or more closed positions.

Any embodiment of any of the present container systems and caps may consist of or consist essentially of—rather than comprise/include/contain/have—the described elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

Details associated with the embodiments described above and others are presented below. Other embodiments of the present caps and container systems are possible.

BRIEF DESCRIPTION OF THE DRAWINGS

The following drawings illustrate by way of example and not limitation. Every feature of a given structure is not always labeled in every figure in which that structure appears, in order to keep the figures clear.

DESCRIPTION OF ILLUSTRATIVE EMBODIMENTS

The term "coupled" is defined as connected, although not necessarily directly, and not necessarily mechanically. The terms "a" and "an" are defined as one or more unless this disclosure explicitly requires otherwise. The terms "substantially," "approximately," "about," and variations thereof are defined as being largely but not necessarily wholly what is specified, as understood by a person of ordinary skill in the art. In one non-limiting embodiment, the term substantially refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a cap or container system that "comprises," "has," "includes" or "contains" one or more elements possesses those one or more elements, but is not limited to possessing only those one or more elements. Likewise, an element of a cap that "comprises," "has," "includes" or "contains" one or more features possesses those one or more features, but is not limited to possessing only those one or more features. For example, a cap that includes a top portion and a bottom portion that includes a centered opening, a first recessed holding element coupled to the centered opening through a first recessed region, a second recessed holding element coupled to the centered opening through a second recessed region, and a raised element coupled to the centered opening is a cap with a bottom portion that includes the specified features but is not limited to having only those features. Such a bottom portion could also include, for example, a second raised element.

Furthermore, a device or structure that is configured in a certain way is configured in at least that way, but it may also be configured in ways other than those specifically described.

Figure 1:
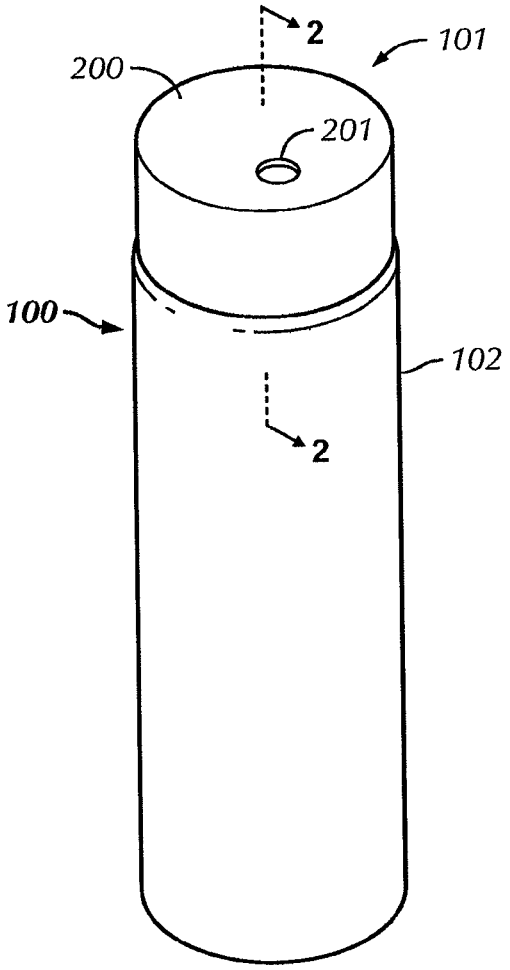
FIG. 1 is a perspective view of one of the present container systems that includes one of the present caps.

FIG. 1 depicts container system 100. System 100 comprises cap or lid 101 operatively coupled to bottle 102. Bottle 102 may be any type of bottle, bin, can, chamber, flask, jar, jug, receptacle, repository, tube, vessel, vial, or the like. A product such as, for example, a cosmetic or food product (not shown) may be stored within bottle 102. Cap 102 allows a consumer to have access to the product in a controlled manner. Particularly, when system 100 is in an open position, the product may be dispensed, for instance, under an externally applied pressure, the force of gravity, or both. When system 100 in a closed position, the product is stopped from leaving bottle 102. Although bottle 102 is shown as having a cylindrical shape, it may have any shape.

Cap 101 allows a user to operate system 100 with the right or left hand. Particularly, cap 101 is configured with a dispensing system that includes two open positions that are on opposite rotational sides of one closed position. As a result, system 100 may assume an open position when cap 101 is turned either clockwise or counterclockwise from its closed position.

In one embodiment, cap 101 comprises top and bottom portions, discussed in more detail below with respect to FIGS. 2 and 3. In another embodiment, cap 101 comprises only a top portion and another portion equivalent to the bottom portion of FIG. 3 may be manufactured or otherwise provided as an integral part of bottle 102.

Figure 2:
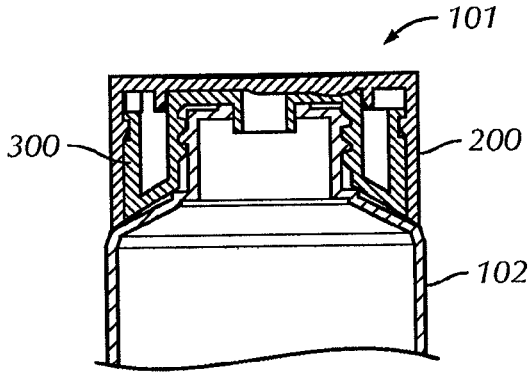
FIG. 2 is a partial cross-sectional view taken along lines 2-2 shown in FIG. 1.

Top portion 200, which is shown in FIG. 1, and bottom portion 300 are shown in cross section in FIG. 2. Top portion 200 includes dispensing element or opening 201, which may be positioned off-center and/or near the edge of top portion 200. When system 100 is in one of its open positions, the product held within bottle 102 can exit cap 101 through opening 201. Bottle 102 may be coupled to the underside of bottom portion 300 in any suitable manner, including via a threaded engagement as shown in FIG. 2 or a snap-fit engagement. For a snap-fit engagement, the bottle and the cap (when the cap is of the two-piece configuration shown in the figures) can be provided with cooperating configurations well known to those of ordinary skill in the art for creating snap-fit engageable parts.

Figure 3:
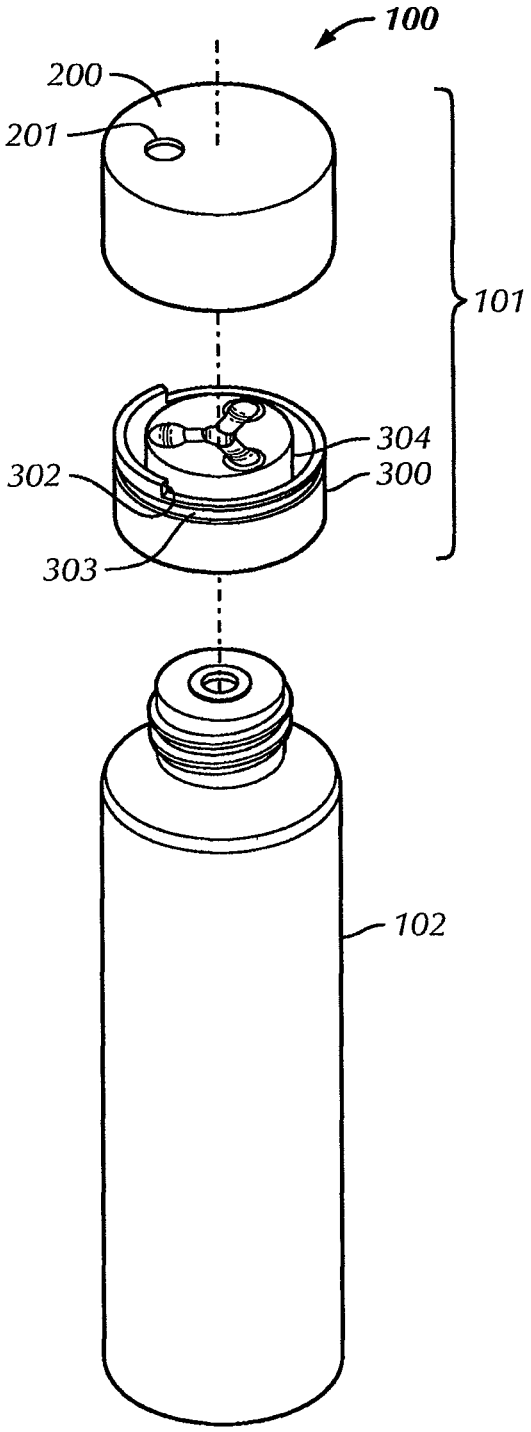
FIG. 3 is an assembly view of the container system shown in FIG. 1.

As shown in FIG. 3, bottom portion 300 includes surface elements on its top surface and, more specifically, on central projection 304. Bottom portion also includes restriction element 302 and rail element 303, which is female in nature. Top portion 200 includes surface elements that interact with the surface elements of bottom portion 300, as described in greater detail below. Top portion 200 also includes stop element 202 that, together with restriction element 302, controls the extent to which the two portions can rotate with respect to each other. In addition, top portion 200 includes one or more male rail elements 203 that ride in rail element 303 of bottom portion 300 and allow the portions to rotate with respect to each other; together these rail elements also serve at least in part as the mechanism that couples the depicted embodiment of top portion 200 and bottom portion 300 together.

Cap 101 may be configured such that the top and bottom portions can be coupled to each other in any suitable manner, such as through a snap fit. This may be achieved by tapering the bottom portion of male rail elements 203 (see FIG. 2 and FIG. 5) such that the top portion can fit down over the bottom portion more easily than if the male rail elements had a rectangular profile.

Figure 4:
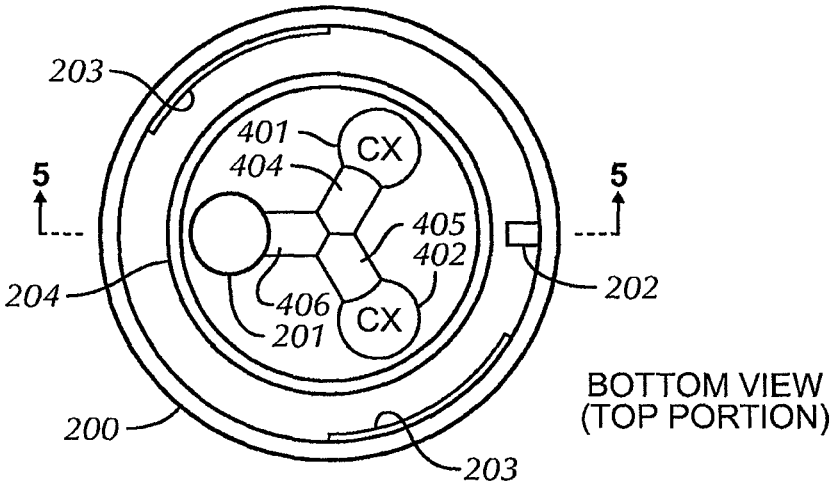
FIG. 4 is a bottom view of the top portion of the cap shown in FIG. 2.
Figure 5:
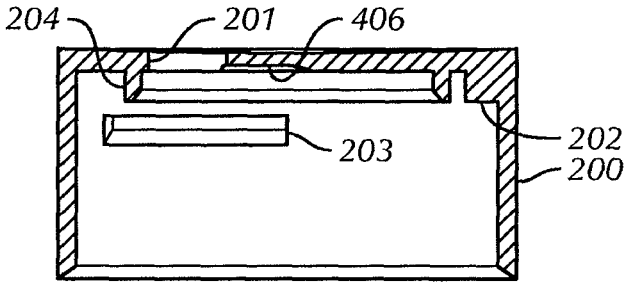
FIG. 5 is a cross-sectional view taken along 5-5 shown in FIG. 4.

FIGS. 4 and 5 are bottom and cross sectional views, respectively, of top portion 200. FIG. 4 shows that the surface elements of the bottom surface of top portion 200 include first protruding or raised (e.g., convex (cx)) element 401 and second raised (e.g., convex) element 402. The surface elements of the bottom surface also include first and second raised (e.g., convex) regions 404 and 405 that extend from elements 401 and 402, respectively, toward a central area of the bottom surface. The surface elements of the bottom surface also include region 406, which may be recessed (e.g., concave) or otherwise indented into the top portion, coupling dispensing element or opening 201 to the central area of the bottom surface.

In addition to showing one or male rail elements 203 and stop element 202, FIG. 5 shows vertical collar 204, which encircles the surface elements of top portion 200 and helps keep top portion 200 centered over bottom portion 300 by contacting central projection 304 of bottom portion 300, as shown in FIG. 2.

Figure 6:
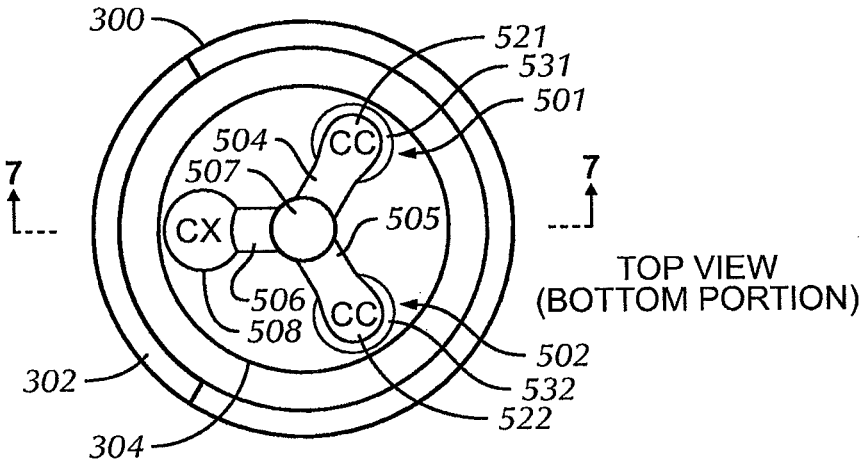
FIG. 6 is a top view of the bottom portion of the cap shown in FIG. 2.
Figure 7:
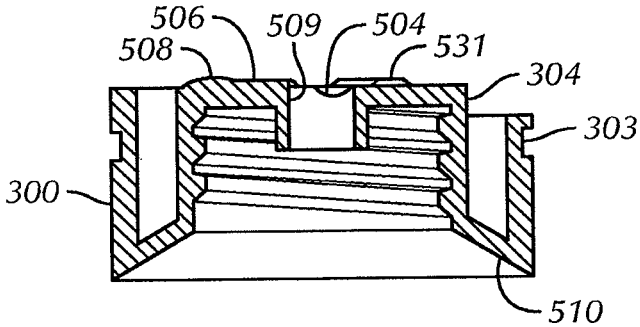
FIG. 7 is a cross-sectional view taken along 7-7 shown in FIG. 6.

FIGS. 6 and 7 are top and cross sectional views, respectively, of bottom portion 300. The surface elements of the top surface of bottom portion 300 include first element 501 (also characterizable as first holding element 501), which includes a centrally oriented recessed (e.g., concave (cc)) portion 521 surrounded in part by a raised lip 531 that serves to help keep the top and bottom portions in a given open position once they get there; second element 502 (also characterizable as second holding element 502), which includes a centrally oriented recessed (e.g., concave (cc)) portion 522 surrounded in part by a raised lip 532 that serves to help keep the top and bottom portions in a given open position once they get there; central opening 507; and raised (e.g., convex (cx)) element 508. Elements 501, 502, and 508 may all be configured to fit with elements 401 and 402 and opening 201. Bottom portion 300 also includes a downwardly-projecting section that defines a passageway 509 extending from central opening 507 and perpendicular to the flat portion of the top surface of bottom portion 300. Recessed (e.g., concave) regions (e.g., channels) 504 and 505 extend from first and second holding elements 501 and 502, respectively, toward a central area of the top surface of bottom portion 300, and may be shaped or contoured to match the shape or contour of raised regions 404 and 405 of the bottom surface of top portion 200 when properly aligned with them. Center opening 507 may be coupled to raised element 508 via raised (e.g., convex) channel 506, which can be shaped to conform to recessed channel 405 of top portion 200.

As a result of the configuration of the top and bottom portions of cap 101, product exiting bottle 102 through opening 507 can flow into channel 504 or 505, depending on which is not occupied by either raised region 404 or 405. The product is then directed by that recessed channel to holding element 501 or 502. Product will be deterred from traveling on the top surface of bottom portion 300 other than through that channel (e.g., either 504 or 505) and into the holding element associated with that channel (e.g., either 501 or 502) because raised regions 404 and 405 will occupy the other of recessed channels 504 and 505 and raised region 506.

Raised region 506 may interfere with raised region 404 or 405 when they are aligned. However, the container system (and more specifically cap 101) may be configured such that there is sufficient "play" in the fit between male rail elements 203 and (female) rail element 303 that the top and bottom portions may tilt somewhat without becoming uncoupled when opposed raised regions 506 and either 404 or 405 are aligned. Alternatively, either or both of raised region 506 and raised element 508 may be configured to be biased toward a raised position (which they would occupy when aligned with recessed region 406 and opening 201, respectively) but depressable to a recessed position when contacted by raised region 404 or 405 and raised element 401 or 402, respectively. Such a configuration may be achieved in a number of different way, such as for example through the material chosen for bottom portion 300 (if raised region 506 and raised element 508 are integral with bottom portion 300), or through the manner in which raised region and/or raised element 508 are coupled to bottom portion 300 if they are made from separate structures (though, in such a case, bottom portion 300 still may be characterized as having or including raised region 506 and raised element 508). Bottom portion 300 may also includes a tapered base section 510 that is configured to contact to some extent an upper tapered portion of container 102, shown in FIG. 2.

Figure 8:
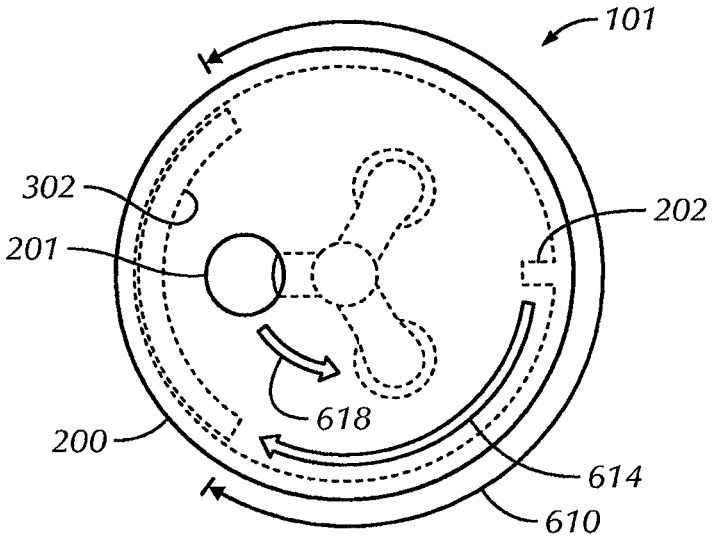
FIG. 8 is a top view of the cap shown in the preceding figures, and illustrates (via hidden lines and arrows) how the two cap portions can rotate with respect to each other.

Top and bottom portions 200 and 300 are couplable to each other and, in operation, can rotate with respect to each other. More specifically, the top surface of bottom portion 300 can rotate with respect to the bottom surface of top portion 200. However, restriction element 302 and stop element 202 are configured to interact with each other to restrict relative movement of the cap portions to less than 360 degrees. For example, bi-directional arrow 610 in FIG. 8 shows that stop element 202 and restriction element 302 may be configured such that stop element 202 is allowed to travel approximately 240 degrees before reaching one side of restriction element 302 from the other side of the restriction element. In other embodiments, the total relative travel between the two may be 120 degrees or less, 90 degrees or less, 60 degrees or less, 40 degrees or less, or any other desired amount.

The depicted embodiment of the present caps is configured such that cap 101 assumes two open positions and one closed position as the user rotates top portion 200 with respect to bottom portion 300. Cap 101 is in an open position when opening 201 is aligned with either first holding element 501 or second holding element 502 of bottom portion 300, thus allowing a product to exit from bottle 102 into bottom portion 300 and out through top portion 200. Cap 101 is in a closed position when opening 201 of the top portion is aligned with raised element 508, as shown in FIG. 8. When top portion 200 is rotated relative to bottom portion 300 in the direction of clockwise arrow 614 from the depicted closed position, opening 201 moves to a first open position over first holding element 501, and the bottom edge (from the perspective shown in FIG. 8) of stop element 202 rests against (or may contact temporarily) the lower edge of restriction element 302. When top portion 200 is rotated relative to bottom portion 300 in the direction of counterclockwise arrow 618 from the depicted closed position, opening 201 moves to a second open position over second holding element 502, and the top edge of stop element 202 rests against (or may contact temporarily) the upper edge of restriction element 302. As shown in the figures, raised element 508 may be positioned mid-way rotationally between first and second holding elements 501 and 502.

In some embodiments, the surface elements of the two portions may be configured to make an audible sound (e.g., a "click") to indicate a particular position is reached, such as an open position or the closed position. The height of raised element 508 may be such that it breaks the plane of the bottom surface of the top portion and protrudes into opening 201 when cap 101 is in its closed position.

The present caps may be made from any of a variety of suitable materials that are well-known to those of ordinary skill in the art. The material chosen may be translucent, transparent, semi-transparent, or opaque in different embodiments.

The present caps and container systems are not intended to be limited to the particular forms disclosed. Rather, they include all modifications, equivalents, and alternatives falling within the scope of the claims. For example, while the dispensing element of the top portion of the cap depicted in the figures is shown as a single opening, in other embodiments the dispensing element comprises multiple (e.g., 2 or more) smaller openings clustered together. Further, while the depicted embodiment of the present caps has been provided with one closed position flanked by two open positions, in other embodiments the surface elements of the bottom portion could be configured with another biased/depressable raised region and raised element surface element (similar to 506 and 508), to increase the number of closed positions to two. In such a case, the surface elements of the bottom portion would be arranged in the shape of a cross. The top portion's surface elements could remain three in number, though their positions would change to a T-configuration. Moreover, the top and bottom portions of the present caps could be configured with any number of alternating open and closed positions.

As another example, the restriction and stop elements can have different configurations than those shown. For instance, multiple restriction elements that are spaced apart from each other may be used rather than a single restriction element as shown in the figures.

The claims are not to be interpreted as including means-plus- or step-plus-function limitations, unless such a limitation is explicitly recited in a given claim using the phrase(s) "means for" or "step for," respectively.

The invention claimed is:

1. A cap comprising:

a top portion comprising a top portion bottom surface and a top portion top surface, wherein a single off-centered opening extends from the top portion bottom surface through the top portion top surface; and a bottom portion comprising a bottom portion bottom surface and a bottom portion top surface, wherein the bottom portion bottom surface comprises a centered opening;

wherein the top portion is couplable to the bottom portion, the top and bottom portions being configured to cause the cap to reach an open position starting from a closed position when:

the top portion is rotated in a clockwise direction with respect to the bottom portion from a closed position; and the top portion is rotated in a counterclockwise direction with respect to the bottom portion from the closed position, wherein the top and bottom portions are configured to restrict relative rotation between them to less than 360 degrees, and wherein the top and bottom portions are configured such that a product can enter the centered opening and exit the single off-centered opening.

2. The cap of claim 1, wherein the top and bottom portions are configured to restrict relative rotation between them to approximately 240 degrees.

3. The cap of claim 1, the top and bottom portions are configured to cause the cap to reach a closed position starting from an open position when:

the top portion is rotated in a clockwise direction with respect to the bottom portion from a first open position; and the top portion is rotated in a counterclockwise direction with respect to the bottom portion from a second position.

4. The cap of claim 1, wherein the wherein off-centered opening is substantially circular in shape.

5. The cap of claim 1, wherein the bottom portion is configured to be coupled to a container.

6. The cap of claim 1, wherein the top and bottom portions are configured with mating rail elements that facilitate their rotation with respect to each other.

* * * * *

UNITED STATES PATENT AND TRADEMARK OFFICE

CERTIFICATE OF CORRECTION

PATENT NO. : 8,561,857 B2
APPLICATION NO. : 13/558134
DATED : October 22, 2013
INVENTOR(S) : DeMarco et al.

It is certified that error appears in the above-identified patent and that said Letters Patent is hereby corrected as shown below:

On the Title Page, Item (73) Assignee, delete "Mark" and insert --Mary-- therefor.

On the Title Page, Item (56) References Cited, line 7, delete "2,381,707" and insert --2,381,207-- therefor.

Signed and Sealed this
Twenty-second Day of April, 2014

Michelle K. Lee

Michelle K. Lee
*Deputy Director of the United States Patent and Trademark Office*